United States Patent [19]

Nishizima

[11] Patent Number: 4,626,486

[45] Date of Patent: Dec. 2, 1986

[54] ELECTROPHOTOGRAPHIC ELEMENT COMPRISING ALLOY OF SELENIUM AND TELLURIUM DOPED WITH CHLORINE AND OXYGEN

[75] Inventor: Hideyo Nishizima, Numazu, Japan

[73] Assignee: Ricoh Co., Ltd., Tokyo, Japan

[21] Appl. No.: 595,017

[22] Filed: Mar. 30, 1984

[30] Foreign Application Priority Data

Apr. 8, 1983 [JP] Japan ..... 58-60968

[51] Int. Cl.[4] ..... G03G 5/082

[52] U.S. Cl. ..... 430/86; 430/95

[58] Field of Search ..... 430/85, 95, 86, 56

[56] References Cited

U.S. PATENT DOCUMENTS 4,046,565 9/1977 Miller ..... 430/84 X
4,286,035 8/1981 Nishizima et al. ..... 430/86 X
4,379,820 4/1983 Nakamura ..... 430/85 X
4,518,671 5/1985 Misumi et al. ..... 430/84

FOREIGN PATENT DOCUMENTS 2849573 5/1979 Fed. Rep. of Germany ..... 430/86

OTHER PUBLICATIONS

Schaffert, Electrophotography, pp. 297–299, 303, 302, J. Wiley & Sons (1976).

*Primary Examiner*—John D. Welsh
*Attorney, Agent, or Firm*—Flynn, Thiel, Boutell & Tanis

[57] ABSTRACT

The electrophotographic element comprising mounting on an electrically conductive substrate a Se-Te-Cl alloy system photoconductive layer which contains Te in the range of 6 to 12 wt. % of Se, Cl in the range of 10 to 30 ppm of the total amount of Se and Te and $O_2$ as impurity 10 ppm or less of the whole alloy, is superior especially in temperature and light fatigue characteristics.

2 Claims, 1 Drawing Figure

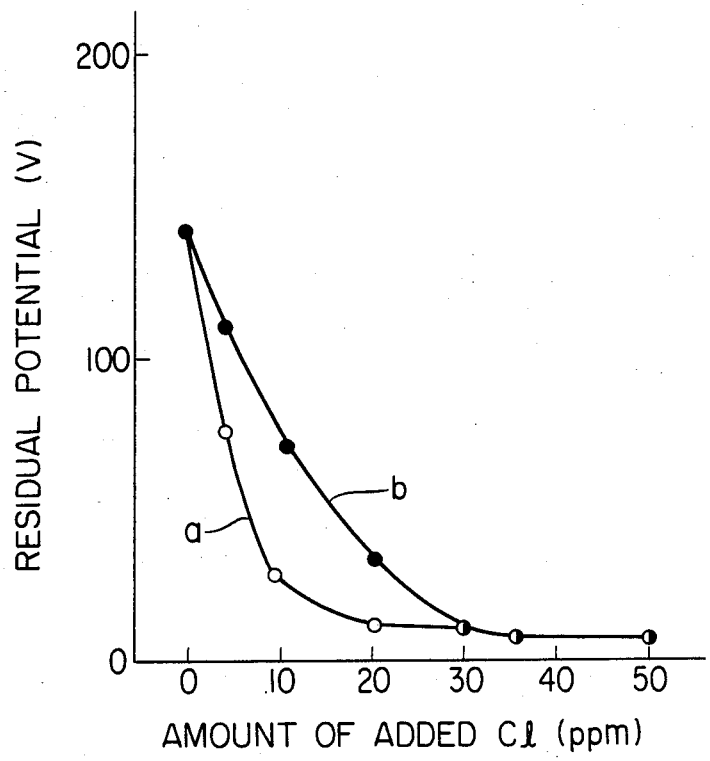
200
100
0
RESIDUAL POTENTIAL (V)
a
b
0
.10
20
30
40
50
AMOUNT OF ADDED Cl (ppm)

ELECTROPHOTOGRAPHIC ELEMENT COMPRISING ALLOY OF SELENIUM AND TELLURIUM DOPED WITH CHLORINE AND OXYGEN

BACKGROUND OF THE INVENTION (a) Field of the Invention

The present invention relates to an electrophotographic element having a Se-Te-Cl system photoconductive layer.

(b) Description of the Prior Art

Since the selenium type electrophotographic element, whose photoconductive layer comprises selenium, utilized widely in the Xerox type electrophotography is hardly sensitive to the red color region, there is also utilized the element having the Te-doped Se layer in order to heighten the sensitivity to the red color region. However, the Se-Te system photoconductive layer of this type is defective in that the residual electric potential is heightened by the hole caused by exposure. In view of this, it has also been tried to neutralize the hole by additionally doping halogen on the Se-Te system photoconductive layer. However, the Se-Te-halogen system like this is defective in that as the amount of halogen added has opposite relationships with the temperature at the time of repetition use (thermal resistance), light fatigue characteristics and residual electric potential, the amount of halogen added must inevitably be restricted. For instance, in the case of Cl, unless it is added generally in excess of 30 ppm, the effect of restricting the residual electric potential is not achieved, and further, if it exceeds 30 ppm, the temperature necessary for repetition use (thermal resistance) and light fatigue characteristics deteriorate and consequently the charged electric potential decreases. It is known that said temperature and light fatigue characteristics are improved with effect by the addition of Sb, Ge and the like (which see Japanese Laid Open Patent Application No. 47654/1979, for instance, concerning the addition of Sb), but these components, as seen in the case of Sb, inversely bring about other drawbacks such as the increase in residual electric potential and the like and furthermore are difficult to be added in the thermal vacuum vapordeposition method, namely the generally known commercial layer forming method, because the vapor pressure of said components is low as compared with that of Se and Te.

SUMMARY OF THE INVENTION

The first object of the present invention is to provide an electrophotographic element that is capable of restricting the residual electric potential and accordingly improving the temperature required for repetition use and light fatigue characteristics even when the amont of Cl addded to Se-Te system is 30 ppm or less.

The second object of the present invention is to provide an electrophotographic element that is capable of dispensing with the addition of a third component to the Se-Te-halogen system and accordingly employing the well known commercial methods in the layer formation without entailing other new drawbacks.

The electrophotographic element according to the present invention comprises an electrically conductive substrate and a Se-Te-Cl alloy system photoconductive layer mounted on said substrate, wherein the amount of Te contained in said alloy is in the range of 6 to 12 wt.% of Se, the Cl content is in the range of 10 to 30 ppm of the total amount of Se and Te, and the content of $O_2$ as impurity is 10 ppm or less of the whole alloy.

DETAILED DESCRIPTION OF THE INVENTION

I have now found that even when the contents of Te and Cl in the usual Se-Te-Cl system alloy photoconductive layer are constant, the residual electric potential varies depending upon the raw material to be used. I have further minutely investigated the raw material based on this finding to find that the amounts of $O_2$ contained as impurity in the raw material participate in changes of the residual electric potential. The present invention has been completed based on these findings.

The electrophotographic element according to the present invention is prepared by vacuum vapor depositing a Se-Te-Cl alloy contaning each of Te, Cl and $O_2$ (impurity) in its predetermined amount onto a heated electrically conductive substrate and thus forming a photoconductive layer comprising said alloy. The Se-Te-Cl alloy used herein contains $O_2$ as impurity, but its content is regulated to be 10 ppm or less. The commercially available Se material and Te material each contains $O_2$ as impurity. In contrast, $Cl_2$ does not contain $O_2$ therein. Accordingly, the control of $O_2$ amount in the Se-Te-Cl alloy may be attained by first calculating the $O_2$ amount contained in the commercially available Se and Te materials and then making the alloy taking account of this $O_2$ amount and the desired Te content. For instance, each raw material of commercially available Se and Te actually contains $O_2$ as mentioned below:

Se material A company: 1 ppm, B company: 10 ppm

Te material C company: 4 to 10 ppm, D company: 80 to 90 ppm.

On the supposition that the Te content in the Se-Te-Cl alloy is 8 wt.%, the $O_2$ amounts in the alloys $H_1$, $H_2$ and $H_3$ using these raw materials are calculated as follows:

$H_1$ (Se material produced by A company + Te material produced by D company) $= 1 \times 0.92 + 90 \times 0.08 = 8.1$ ppm $H_2$ (Se material produced by B company + Te material produced by D company) $= 10 \times 0.92 + 90 \times 0.08 = 16.4$ ppm $H_3$ (Se material produced by A company + Te material produced by C company) $= 1 \times 0.92 + 4 \times 0.08 = 1.24$ ppm That is, the alloys $H_1$ and $H_3$, the $O_2$ amount being each less than 10 ppm, may be said to be Se-Te-Cl alloys suitable for use in the present invention. In this connection, the analytical methods of $O_2$ in metals are disclosed, for instance, in the following documents:

T. Hauskrecht, Dissertationsarbeit, Tech.Hochschule, Gras 1957.

Ake Olofsson, Analysmetodikundersokning nr 137.

P W West and G C Gache, Anal. Chem. 28, 1816(1956).

S Barabas and J Kaminski. Andl. Chem. 35, 1702(1963).

The Se-Te-Cl alloy available for the present invention can be obtained by the steps of previously determining the $O_2$ amount in the manner as described above, then making a Se-Te alloy containing a desired amount of Te in a usual manner (vacuum vapor-deposition) useing Se and Te materials each in an amount corresponding to this $O_2$ amount, and further doping a desired amount of Cl into the thus obtained Se-Te alloy.

In the Se-Te-Cl alloy system photoconductive layer according to the present invention, Te is a material for sensitizing Se and its optimum content is in the range of 6 to 12 wt.% of Se. In case the Te content is less than 6%, it can not exert a sufficient sensitizing operation upon Se, while in case said content is more than 12%, the residual electric potential is heightened by holes caused at the time of exposure. Referring to Cl, it is a material which acts, as a donor, to neutralize holes, which otherwise are trapped in the layer, so as to prevent the residual electric potential from increasing, and its optimum content is in the range of 10 to 30 ppm of the Se-Te alloy. In case the Cl content is less than 10 ppm, holes are neutralized insufficiently, while in case said content is more than 30 ppm the temperature and light fatigue characteristics deteriorate. Further, although the $O_2$ content may be controlled to be less than 10 ppm, in case it is in excess of 10 ppm, the residual electric potential is heightened depending upon the raw materials to be used so that the object of the present invention can not be achieved.

As the electrically conductive substrate for mounting the above mentioned Se-Te-Cl alloy system photoconductive layer there is generally used an Al plate or an Al drum. In addition thereto, there may be used, for that purpose, metals such as stainless, Ni, Ir, Au, Cr, Mo, Pt and the like or plates or drums consisting of their alloys; or plastic films, glass plates, ceramic plates and the like obtained by conductive treatment of aforesaid metals or alloys according to the method using vacuum vapordeposition, sputtering, electron beam irradiation or the like.

The example of the present invention will be explained with reference to the FIGURE hereinafter.

BRIEF DESCRIPTION OF THE FIGURE

The FIGURE is a view illustrating the relationship between the amounts of Cl added and the residual electric potential in the element of the present invention (Curve a) provided with the Se-Te-Cl alloy system photoconductive layer containing a small amount of $O_2$ and a control element (Curve b) provided with a Se-Te-Cl alloy system photoconductive layer containing a large amount of $O_2$.

EXAMPLE

By subjecting a Se material containing 5 ppm of $O_2$ and a Te material containing 10 ppm of $O_2$ to the vacuum distillation method, there was prepared a Se-Te alloy containing 8 wt.% of Te. Further, by doping said alloy with 5, 10, 20, 30, 35 and 50 ppm of Cl respectively, there were prepared Se-Te-Cl alloys A containing 5.4 ppm of $O_2$. By repeating the exactly same procedure excepting the use of a Se material and a Te material containing 30 ppm and 50 ppm of $O_2$ respectively, there were prepared Se-Te-Cl alloys B containing 31.6 ppm of $O_2$.

Next, 12 kinds of respective alloys obtained as described above were each placed in a cylindrical stainless boat. Above said boat there was disposed an Al drum. Then, under the conditions: drum temperature 70° C. and degree of vacuum $1\times10^{-5}$ Torr, those alloys were subjected to 40 minutes' vacuum vapordeposition, thereby forming 60 $\mu$-thick Se-Te-Cl alloy system photoconductive layers thereon.

Next, the thus obtained electrophotographic elements were subjected to 3 days' dark adaptation, and thereafter the process comprising electrification-exposure-deelectrification was repeated 100 times at the rotary speed of 33.3 rpm per one process by means of an electrophotographic element tester, thereby measuring the residual electric potential respectively. The residual electric potential (background electric potential $V_L$ after exposure) referred to herein is represented by the difference (the amount increased) between 1st $V_L$ and 100th $V_L$. The thus obtained results are as shown in the accompanying drawing. It can be seen from this drawing that until the amounts of Cl added amount to 30 ppm, the elements of the present invention (Curve A) using the small amount of $O_2$-containing alloy A are lower in residual electric potential than the control elements (Curve B) using the large amount of $O_2$-containing alloy B.

I claim:

1. An electrophotographic element comprising an electrically conductive substrate and a Se-Te-Cl alloy system photoconductive layer mounted on said substrate, wherein the amount of Te contained in said alloy is in the range of 6 to 12 wt.% of Se, the Cl content is in the range of 10 to 30 ppm of the total amount of Se and Te, and the content of $O_2$ as impurity is 10 ppm or less of the whole alloy.

2. An electrophotographic element comprising an electrically conductive substrate having a photoconductive layer thereon, said photoconductive layer consisting of an alloy of selenium and tellurium in an amount of from 6 to 12% by weight, based on selenium, said alloy being doped to contain from 10 to 30 ppm of chlorine of the total amount of selenium and tellurium, said alloy containing, as an impurity, 10 ppm or less of oxygen, said photoconductive layer having been applied onto said substrate by vacuum vapor-deposition.

* * * * *